US010337279B2

(12) United States Patent
Frazier

(10) Patent No.: US 10,337,279 B2
(45) Date of Patent: Jul. 2, 2019

(54) DISSOLVABLE DOWNHOLE TOOLS COMPRISING BOTH DEGRADABLE POLYMER ACID AND DEGRADABLE METAL ALLOY ELEMENTS

(71) Applicant: MAGNUM OIL TOOLS INTERNATIONAL, LTD., Corpus Christi, TX (US)

(72) Inventor: W. Lynn Frazier, Corpus Christi, TX (US)

(73) Assignee: MAGNUM OIL TOOLS INTERNATIONAL, LTD., Corpus Christi, TX (US)

( * ) Notice: Subject to any disclaimer, the term of this patent is extended or adjusted under 35 U.S.C. 154(b) by 193 days.

(21) Appl. No.: 15/403,739

(22) Filed: Jan. 11, 2017

(65) Prior Publication Data

US 2017/0234103 A1 Aug. 17, 2017

Related U.S. Application Data

(63) Continuation-in-part of application No. 15/189,090, filed on Jun. 22, 2016, which is a continuation-in-part
(Continued)

(51) Int. Cl.
*E21B 33/129* (2006.01)
*E21B 33/128* (2006.01)
(Continued)

(52) U.S. Cl.
CPC ..... *E21B 33/1291* (2013.01); *E21B 33/128* (2013.01); *E21B 33/134* (2013.01); *E21B 34/063* (2013.01); *E21B 43/26* (2013.01)

(58) Field of Classification Search
CPC ..... E21B 33/1291
See application file for complete search history.

(56) References Cited

U.S. PATENT DOCUMENTS 4,655,247 A 4/1987 Westra et al.
5,709,269 A 1/1998 Head
(Continued)

FOREIGN PATENT DOCUMENTS

JP 2013183363 12/2013
WO 2012121294 9/2012
(Continued)

OTHER PUBLICATIONS

PCT/JP2015/076150. International Preliminary Report and Written Opinion, 9 pages dated Apr. 6, 2017.

*Primary Examiner* — Giovanna C Wright
(74) *Attorney, Agent, or Firm* — Jackson Walker, LLP

(57) ABSTRACT

A degradable downhole isolation tool for use in hydrocarbon well completion. The tool sets and isolates zones for fracking, and then degrades without leaving residual parts and without milling or introducing a new degrading fluid. The plug's mandrel and other parts are a solid polymer which hydrolyzes in aqueous downhole fluid to produce an acid which degrades degradable metal slips and other metal parts. The plug's seal may be degradable metal pedals or split rings. The plug is delivered to the well site as an interchangeable parts kit for adaption to the well's requirements.

46 Claims, 7 Drawing Sheets

Related U.S. Application Data of application No. 14/677,242, filed on Apr. 2, 2015, now Pat. No. 10,119,359, which is a continuation-in-part of application No. 14/677,242, filed on Apr. 2, 2015, now Pat. No. 10,119,359.

(60) Provisional application No. 61/974,065, filed on Apr. 2, 2014, provisional application No. 62/003,616, filed on May 28, 2014, provisional application No. 62/019,679, filed on Jul. 1, 2014, provisional application No. 62/253,748, filed on Nov. 11, 2015, provisional application No. 62/406,195, filed on Oct. 10, 2016.

(51) Int. Cl.

| | |
|---|---|
| ***E21B 33/134*** | (2006.01) |
| ***E21B 34/06*** | (2006.01) |
| ***E21B 43/26*** | (2006.01) |

(56) References Cited

U.S. PATENT DOCUMENTS

| | | | | |
|---|---|---|---|---|
| 7,093,664 | B2 | 8/2006 | Todd et al. | |
| 7,900,696 | B1 | 3/2011 | Nish | |
| 8,079,413 | B2 * | 12/2011 | Frazier | E21B 33/134 166/124 |
| 8,211,247 | B2 | 7/2012 | Marya | |
| 8,694,714 | B2 | 4/2014 | Xu et al. | |
| 9,518,442 | B2 | 12/2016 | Xu et al. | |
| 9,757,976 | B2 | 9/2017 | Sherman et al. | |
| 2002/0014339 | A1 | 2/2002 | Ross | |
| 2003/0164237 | A1 | 9/2003 | Butterfield | |
| 2005/0189103 | A1 | 9/2005 | Roberts et al. | |
| 2005/0205265 | A1 * | 9/2005 | Todd | E21B 23/00 166/376 |
| 2009/0255686 | A1 | 10/2009 | Hughes | |
| 2011/0003930 | A1 | 1/2011 | Brunett | |
| 2011/0048743 | A1 * | 3/2011 | Stafford | E21B 33/134 166/386 |
| 2011/0056677 | A1 | 3/2011 | Holderman | |
| 2011/0067889 | A1 | 3/2011 | Marya et al. | |
| 2011/0278011 | A1 * | 11/2011 | Crainich, Jr. | C04B 40/0092 166/310 |
| 2012/0181032 | A1 | 7/2012 | Naedler et al. | |
| 2012/0292053 | A1 | 11/2012 | Xu et al. | |
| 2013/0043041 | A1 | 2/2013 | Hughes | |
| 2013/0081801 | A1 | 4/2013 | Liang et al. | |
| 2013/0081821 | A1 | 4/2013 | Liang | |
| 2013/0118759 | A1 | 5/2013 | Hughes | |
| 2013/0048305 | A1 | 8/2013 | Hughes | |
| 2013/0199800 | A1 | 8/2013 | Kellner et al. | |
| 2013/0240200 | A1 | 9/2013 | Frazier | |
| 2013/0240201 | A1 | 9/2013 | Frazier | |
| 2013/0240203 | A1 | 9/2013 | Frazier | |
| 2013/0300066 | A1 | 11/2013 | Xu et al. | |
| 2013/0306327 | A1 | 11/2013 | Williamson | |
| 2013/0319668 | A1 | 12/2013 | Tschetter et al. | |
| 2013/0319682 | A1 | 12/2013 | Tschetter et al. | |
| 2013/0333891 | A1 | 12/2013 | Fripp et al. | |
| 2014/0000894 | A1 | 1/2014 | Coffey et al. | |
| 2014/0014339 | A1 | 1/2014 | O/Malley et al. | |
| 2014/0020911 | A1 | 1/2014 | Martinez | |
| 2014/0027128 | A1 | 1/2014 | Johnson et al. | |
| 2014/0041857 | A1 | 2/2014 | Xu et al. | |
| 2014/0060813 | A1 | 3/2014 | Naedler et al. | |
| 2014/0096970 | A1 | 4/2014 | Andrew et al. | |
| 2014/0102709 | A1 | 4/2014 | Arabskyy | |
| 2014/0116677 | A1 | 5/2014 | Sherlin | |
| 2014/0116721 | A1 | 5/2014 | Hofman et al. | |
| 2014/0116731 | A1 | 5/2014 | Themig et al. | |
| 2014/0116775 | A1 | 5/2014 | Coffey et al. | |
| 2014/0166292 | A1 | 6/2014 | Crowley | |
| 2014/0182862 | A1 | 7/2014 | Derby | |
| 2014/0196899 | A1 | 7/2014 | Jordan et al. | |
| 2014/0224476 | A1 | 8/2014 | Frazier | |
| 2014/0224477 | A1 | 8/2014 | Wiese et al. | |
| 2014/0231069 | A1 | 8/2014 | VanLue | |
| 2014/0231099 | A1 | 8/2014 | Barbee et al. | |
| 2014/0246189 | A1 | 9/2014 | Beason et al. | |
| 2014/0246208 | A1 | 9/2014 | Themig et al. | |
| 2014/0248448 | A1 | 9/2014 | Sjostedt | |
| 2014/0251594 | A1 | 9/2014 | Garcia et al. | |
| 2014/0251612 | A1 | 9/2014 | Powers | |
| 2014/0251636 | A1 | 9/2014 | Hofman et al. | |
| 2014/0251641 | A1 | 9/2014 | Marya | |
| 2015/0096741 | A1 | 4/2015 | Okura et al. | |
| 2015/0354311 | A1 * | 12/2015 | Okura | B29C 47/0004 175/57 |
| 2016/0151831 | A1 | 6/2016 | Olsen | |
| 2016/0186511 | A1 * | 6/2016 | Coronado | E21B 33/128 166/381 |
| 2016/0230494 | A1 | 8/2016 | Fripp et al. | |
| 2016/0230498 | A1 | 8/2016 | Walton et al. | |
| 2016/0376869 | A1 * | 12/2016 | Rochen | E21B 23/06 166/135 |
| 2017/0175481 | A1 | 6/2017 | Kobayashi et al. | |
| 2017/0218720 | A1 | 8/2017 | Takahashi et al. | |
| 2017/0268307 | A1 | 9/2017 | Cooke | |
| 2017/0284167 | A1 | 10/2017 | Takahashi et al. | |

FOREIGN PATENT DOCUMENTS

| | | |
|---|---|---|
| WO | 2014098903 | 6/2014 |
| WO | 2014109347 | 7/2014 |
| WO | 2016016628 | 2/2016 |
| WO | 2017082865 | 5/2017 |
| WO | 2017116407 | 7/2017 |

* cited by examiner

DISSOLVABLE DOWNHOLE TOOLS COMPRISING BOTH DEGRADABLE POLYMER ACID AND DEGRADABLE METAL ALLOY ELEMENTS

RELATED APPLICATIONS

This is a utility patent application which claims priority to and incorporates by reference U.S. Provisional Patent Application Nos. 62/253,748, filed Nov. 11, 2015, and 62/406,195, filed Oct. 10, 2016. This application is a continuation-in-part of, claims priority to, and incorporates by reference co-pending U.S. patent application Ser. No. 14/677,242, filed Apr. 2, 2015, which claims priority to U.S. Provisional Patent Application Nos. 61/974,065; 62/003,616; and 62/019,679.

FIELD OF THE INVENTION

The field of the invention is interventionless downhole tools, having both solid degradable polymeric acid elements and degradable metal elements.

BACKGROUND OF THE INVENTION

Downhole tools such as bridge plugs, packers, cement retainers or other plugs, and other settable plugs, may have dissolvable elements. The downhole tools may be set and adapted to dissolve in natural or in introduced downhole fluids.

SUMMARY OF THE INVENTION

An interventionless downhole tool for temporarily isolating zones in a wellbore is provided, in a number of different embodiments. The term "downhole tool" refers to any tool used to permanently or temporarily isolate one wellbore zone from another, including, without limitation, any tool with blind passages or plug mandrels, as well as open passages extending completely therethrough and passages blocked with a check valve, ball etc. Such tools are sometimes referred to in the art as "bridge plugs," "frac plugs," and/or "packers." Such tools can be part of a single assembly (e.g., one plug) or comprise two or more assemblies (e.g., two or more plugs) disposed within a work string or otherwise connected run with a wire line, slip line, production tubing, coil tubing or any technique known or yet to be discovered in the art.

Plugs are "interventionless" if they do not have to be milled or drilled or retrieved from the well so completion can continue, but rather can be left in the well where they degrade, disintegrate or dissolve to the same effect. Interventionless downhole plugs may save time and expense in well completion and workover processes, including fracing and/or acid completions. In some embodiments, settable downhole tools combine one or more polymeric or polymer acid elements with one or more degradable metallic elements to produce a tool which sets, and sufficiently degrades to no longer interfere with fluid flow through the casing without drilling out. In some embodiments, the degradable elements are disclosed in US patent applications: Ser. No. 13/893,160, filed May 13, 2013; Ser. No. 14/132,608, filed Dec. 18, 2013; and Ser. No. 14/677,242, filed Apr. 2, 2015, all incorporated herein by reference. In one embodiment, the degradable polymer acid elements are non-composite elements and the degradable metallic elements are non-iron. Composite downhole tool elements tend to typically include a woven fabric and resin, such as a fiberglass. Unless otherwise indicated herein, "metal" includes in some embodiments pure metal and in other embodiments metal alloys. In some embodiments, the non-iron, degradable metallic elements may be aluminum (meaning pure aluminum or aluminum alloy) or magnesium (meaning pure magnesium or magnesium alloy) combined with the degradable non-metallic elements. In some embodiments, the degradable metallic elements include a shear sub and/or slips and the non-metallic polymer acid degradable elements may include a mandrel. In some embodiments, the slips include a body with cast iron inserts or other hard metal inserts, the body being comprised of a degradable non-iron metallic element.

A degradable settable downhole tool for engaging a casing at a rated setting strength, the casing containing a downhole fluid, typically an aqueous completion fluid, which may be freshwater or contain a salt of various concentrations, most typically about 2% NaCl or other chloride. In one embodiment, the tool has a degradable mandrel comprising at least in part, a degradable solid high molecular weight acid polymer which is strong and hard enough to function as a mandrel and degradable enough in the downhole fluid to release an acid into the downhole fluid for the functions described herein.

For example, the polymer acid solid may be a pH neutral, high molecular weight PLA, PGA, PHA or any polymerized acid which is both (1) strong and hard enough to function as a tool element, and (2) hydrolyzes in the aqueous drilling fluid to release acid quickly enough to degrade the metal elements. For example, a solid high molecular weight polyglycolic acid, such as Kuredux, releases glycolic acid in an aqueous solution and a solid high molecular weight polylactic acid polymer releases a lactic acid in solution. Other polymers that degrade and release acid in an aqueous solution are found in U.S. Pat. No. 7,353,879, incorporated herein by reference. In some embodiments, the solid acid polymer elements of the tool react by hydrolysis in the aqueous downhole fluid, releasing acids into the downhole fluid. The acid speeds degradation of nearby tool metallic elements, such as load rings and/or slips and/or bottom cones, which may be made of ferric or non-ferric metals or any acid degradable material.

In a preferred embodiment, the high molecular weight degradable polymer degrades by hydrolysis, and may include at least partly PLA and or PGA or blends thereof. In some cases, the hydrolysis may be bulk hydrolysis and the degradation may include external erosion. The polymers may be part of a composite body formed with resin comprised of polymer acid and/or coated degradable polymer fibers. In other embodiments, the polymer part may be non-composite. In a preferred embodiment, the polymer comprises at least the cylindrical mandrel in the degradable metallic elements are one or more structural elements that encircle the mandrel. In a preferred embodiment, one or more of the load ring, slips or bottom cone is metallic and other elements (except perhaps set screws), are made of solid polymer acid or other acid releasing composition, which composition is strong enough to withstand the compressive and shear forces involved in the setting the tool.

A polymer is a natural, semi-synthetic or synthetic solid formed by combining multiple identical units called monomers, and may be degradable in an aqueous solution by hydrolysis or any other mechanism. Polyglycolic acid is a degradable aliphatic polyester which is prepared from glycolic acid. Polylactic acid is an aliphatic polyester polymer that may degrade in aqueous solutions. While not be constrained by theory, polymer acids that are at least partially degradable in aqueous solution may release an acid or lower the pH of an aqueous solution which will synergistically speed the degradation of the metal components in close proximity to the polymer acid. Moreover, it is believed that mechanical loading of some polymer acids, such as PGA, may increase the rate of degradation in the aqueous fluid. Degradable materials as used herein, including polymer acids, are any materials suitable for service in a downhole environment and provides adequate strength to enable proper operation of the tool. U.S. Pat. Nos. 7,353,879 and 7,093,664 are incorporated herein by reference and includes some non-limiting examples of degradable materials, including polylactides and polyglycolides.

In a preferred embodiment, the metallic elements are nonferrous and comprise an alloy of aluminum, magnesium, zinc or chromium. Although these elements do not typically dissolve quickly enough in freshwater to be considered degradable, in the presence of sufficient acid released from the mandrel, they degrade quickly enough to be considered degradable. Fluid is considered to be aqueous herein if the fluid comprises water alone or if the fluid contains water. In the embodiments disclosed herein, the degradable components degrade to modify the downhole fluid to synergistically increase the rate of degradation of the metal components of the downhole tool. While not bound by theory, it is believed that at sufficient acid concentrations adjacent the metal, metal oxidation caused by the acid produces bubbles on the metal surface which speed degradation by churning the adjacent fluid, disturbing incompletely reacted metal and perhaps moving unreacted metal fragments from the metal part.

Salinity may aid degradation of the metal. Some completion fluids already have sufficient salt. The metallic elements' degradation may be enhanced by adding dissolved salt to the downhole fluid, or enough may be present naturally in the downhole fluid. In one embodiment, salt may be added to a completion fluid or to water prior to insertion of the downhole tool described herein into the well, to bring the fluids' salinity to the range of about 0.1 to 5%, preferably about 2% to 3%. The acid released from the solid polymer acid elements of downhole tool operates synergistically with salt in the downhole fluid to materially increase the metal's rate of degradation.

In preferred embodiments, within a range of at least about three hours to one day, the tool maintains its engagement with the casing at its rated setting. Changing the tool's composition and configuration can vary the tool's engagement with the casing in about one hour increments. The tool ultimately sufficiently degrades to release from the casing. The tool continues to degrade and within range of about one day to 21 days there is a sufficiently complete degradation of the tool's major elements (metallic and non-metallic) to allow substantially full flow of fluid through the wellbore where the tool had isolated zones in the well. Changing the tool's composition and configuration varies degradation at about one day increments. The tool preferably degrades within less than five days, and most preferably, within a period of from one to three days, or from one to two days, to permit for full production from the well. Changing the tool's composition and configuration varies the degradation in about one day increments. Ultimately, all of the tool's major elements fully degrade within at least six months, so remnants of the tools are not collected in the heel of the well or in the horizontal legs of the well where they may interfere with later completion operations.

Without being bound by theory, the mechanism is believed to be that the mandrel's degradable polymer degrades, releasing acid into the downhole fluid. The mandrel's released acid sufficiently degrades the tool's nonferrous metal elements, so the full tool degrades to not substantially interfere with fluid flow through the casing, so hydrocarbons can be produced from the well without drilling or milling the tool or introducing a new degrading fluid to the tool. Thus, for the described embodiment, after the tool is set to isolate a zone and the isolated zone is fraced, the well can be shut in for three days, more or less, and then opened for hydrocarbon production. No milling or drilling of the tool, insertion of new or additional degrading fluids into the well, or removal of the downhole tool is required.

In some embodiments, increasing the surface area of a metallic element may increase the rate of degradation. The rate of degradation of the polymer may be controlled, increasing or decreasing this rate may increase or decrease the rate of degradation of the metal elements.

At least the cone or the slip body may comprise, at least in part, a degradable metal alloy that in an aqueous brine solution at a temperature between about 100° F. and 250° F., will, depending on composition and configuration, degrade at least 10%, 20%, 30%, 40% or 50% faster in the presence of the polymer acid released from the mandrel's acid polymer than the cone or slip would degrade in the absence of the acid released from the mandrel's acid polymer. The tool, in one embodiment, will maintain its rated setting strength after engaging the casing containing the downhole fluid for at least about six hours, and will sufficiently degrade in about four to fourteen days or less to permit completion operations in the casing without drilling out the tool. The central elastomer at least partly dissolves in the downhole fluid.

The degradable acid polymer, in one embodiment, is at least in part a PGA or PLA polymer. The degradable acid polymer, in one embodiment, is DCP or its equivalent, if available, from Bubbletight, Inc. of Needville, Tex. In another embodiment, it is Kuredux brand PGA or its equivalent, available from Kureha America (New York, N.Y.).

The degradable metal alloy, in one embodiment, is a degradable zinc alloy. The degradable metal alloy, in one embodiment, is a magnesium alloy as described in U.S. Patent Application No. 2016/0024619, incorporated herein by reference; wherein the degradable metal alloy is degradable in the presence of water and chlorides and a pH of less than 7. The metal alloy, in one embodiment, comprises two slips, a bottom cone, a shear release shear sub and, optionally, a load ring. The degradable metal alloy, in one embodiment, is magnesium MOT E1, in one embodiment either SoluMag™ or Tervalloy™ or their equivalent, available from Terves, Inc. of Euclid, Ohio. The polymer, in one embodiment, is degradable PGA or PLA and may comprise a top cone, a bottom sub and, optionally, a shoe nut bottom. The central elastomer is dissolvable. The slips, in one embodiment, have heat treated ductile iron buttons or heat treated powder metal buttons. The slips may include two slips. In one embodiment, the slips include a load ring and a shear sub, all comprising at least in part a degradable magnesium alloy.

In one embodiment, a top cone and a bottom cone and a shoe nut bottom, all the foregoing and the mandrel may at least partly comprise a poly acid plastic, for example, DCP from Bubbletight. The central elastomer may be a dissolvable rubber or plastic, such as DEP from Bubbletight or KDR from Kureha America. The degradable metal of any metal part may be as disclosed in US 2015/0240337; US 2015/0299838; or US 2015/0239795, all incorporated herein by reference and assigned to Terves, Inc., Euclid, Ohio.

A degradable settable downhole tool is disclosed in one embodiment having a rated setting strength for engaging a casing containing a downhole fluid, the downhole tool comprising: a mandrel; a slip having a slip body; a cone proximate the slip; and wherein at least one of the foregoing elements comprises, as least in part, a polymer acid that will degrade and release an acid into the downhole fluid, and wherein at least another of the foregoing elements comprises, at least in part, a metal or metal alloy whose rate of degradation in a fluid will increase in the presence of polymer acid than in the same fluid without the acid. A central elastomer is provided which, in one embodiment, may be degradable. The tool may be configured to be set in the casing to isolate a zone above the tool from a zone below the tool, to preferably hold its rated strength for at least about six hours after entry into the downhole fluid in the casing, and after about one to three days to have degraded to not interfere with fluid flow at the setting location. In alternative embodiments, the tool is comprised and configured to hold its rated strength in the range of about three to 12 hours and is comprised and configured to sufficiently degrade thereafter so fluid may flow through the casing without interference from the plug in the range of about 12 hours to five days.

A degradable settable downhole tool is provided for engaging a casing in a well containing an aqueous downhole fluid comprising at least about 2% KCl or other salt, the downhole tool, in one embodiment, comprising: a mandrel comprising a degradable acid polymer which will degrade in the downhole fluid and release an acid into the downhole fluid; a slip proximate the mandrel having a slip body, and a cone proximate the slip; wherein the tool is configured to be settable in the casing to isolate a zone above the tool from a zone below the tool. Either or both the cone or slip body may comprise a degradable metal alloy which degrades faster in the downhole fluid in the presence of the acid released from the mandrel's acid polymer than in the downhole fluid in the absence of the acid. If the tool is set in the downhole fluid having a temperature of at least 100° F., the tool will release from the casing at least about 10% faster in the presence of the acid released from the mandrel's acid polymer than if the mandrel which did not release acid polymer. The tool, in one embodiment, will remain set in the casing and isolating the zones for at least about six hours after entry into the downhole fluid, and degrade to cease interfering with fluid flow through the casing in two to five days after entry into the downhole fluid.

An at least partly degradable settable downhole tool having a rated setting strength for engaging a casing containing a downhole fluid, the downhole tool comprising: a mandrel; a slip having a slip body; a cone proximate the slip; and wherein at least one of the foregoing elements comprises, as least in part, a hard polymer acid solid that will degrade in the downhole fluid and release an acid into the downhole fluid, and wherein at least one of the foregoing elements comprises, at least in part, a metal alloy which will degrade faster in the downhole fluid in the presence of the acid than in the same fluid without the polymer acid; and may, in one embodiment, include a central degradable elastomer; and wherein the tool may be configured to be set in the casing to isolate a zone above the tool from a zone below the tool, hold its rated strength for at least six hours after entry into the downhole fluid in the casing, and in different embodiments after about 12 hours, one day, two days, three days increasing in about daily units up to about 14 days has degraded such that it will not interfere with fluid flow at the setting location.

The '242 application incorporated herein by reference includes FIGS. 1, 1A, 2, 3, 3E, 3E1, 3F, 4, 4C, 4D, 5, 6A, 8A-8D, 9A, 9B, 10A-10E, 11A-11B, and 12A-12B, which show a plug with dissolvable aluminum. Any of the structural features in these figures may be comprised of a hard non-metallic polymer acid solid and other of the features may be comprised of dissolvable non-iron components. When the term "degradable metal" is used, it means a degradable metal or a metal alloy degradable in the presence of sufficient polymer acid. For example, degradable aluminum means aluminum or aluminum alloy degradable in the presence of sufficient acid.

DETAILED DESCRIPTION

Figure 1:
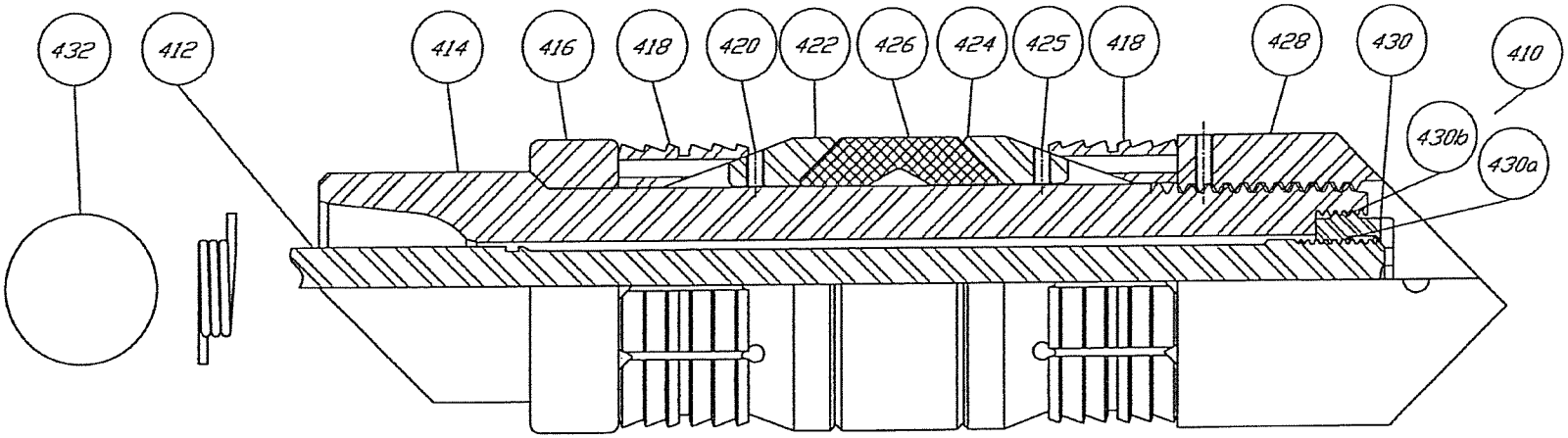
FIG. 1 is a partly cutaway elevational view of one embodiment of a downhole tool.

FIGS. 1, 2, 3A-3F, 4, and 7 illustrate a settable downhole tool 410 (or parts thereof) with at least some of its elements or parts made of a hard dissolvable polymer solid, in one embodiment, a dissolvable high molecular weight polyglycolic acid polymer (for example, a polymer comprising at least in part a PGA (polyglycolic acid) or PLA (polylactic acid) polymer acid). Several such degradable polymer acid compositions are described in application Ser. No. 14/132,608 for DOWNHOLE TOOLS HAVING NON-TOXIC DEGRADABLE ELEMENTS, which is incorporated herein by reference. In one embodiment, the polyglycolic acid is Kuredux® by Kureha or its equivalent. In another embodiment, the dissolvable elements or parts are made from degradable PGA or PLA or other degradable polymeric materials, such as described in PCT/JP2014/083843, published Jul. 2, 2015 or their equivalents. In another embodiment, the dissolvable acid polymer is polylactic acid. In another embodiment, the degradable parts are a mix of polymeric acid polymers. Degrade as used in this application means to disintegrate, dissolve, corrode, be consumed or degrade or partially or totally go into solution in the presence of a naturally occurring or human introduced downhole fluid, for example water, oil, acid solution or brine. In one embodiment, the acid polymer is hydrolytically degradable in aqueous downhole fluid.

In one embodiment, a degradable settable downhole tool has both metal alloy and polymer acid elements, and the corrosion rate of its metal components is faster than if the polymer acid elements were not present. In one case, the rate increase may be measured by using two beakers containing equal amounts of aqueous brine solution of about 2% KCl (containing chlorine ions), at the same temperature, for example, between about 100° F. and 250° F. A sphere of the metal is placed in each beaker, but in one beaker is also placed a hard solid sphere of equal mass of an acid polymer, such as PGA or PLA, which will release acid as it degrades in the aqueous solution. Changes in the masses of metal and/or the diameters of the metal spheres over time (typically hours or days) is recorded. The rate of degradation may be determined in percent loss of surface area (which may be expressed as a loss in thickness of a metallic element of a downhole tool) or mass lost per unit of time. The downhole tool is comprised to degrade at a faster rate with the acid polymer solid's released acid than without the acid polymer solid's acid. Another method is to determine from the metal suppliers or manufacturers their published degradation rates for the metal a tool part is made from. The downhole tool is comprised to degrade faster rate than the published rate when in the presence of a material amount of a polymer acid. In one embodiment, the rate of increase is at least about 10%. In another embodiment, at least about 20%; in a third embodiment, about 30% or more. In some embodiments, a material amount of polymer acid is any amount where one of the following elements is polymer acid and another is a degradable metal: mandrel, slips, cones and the degradation rate of the metal is increased by 10%. Target degradation rate increases for a tool downhole are substantial, such as in the range of about 10%, 20%, 30%, 40% or 50%.

A downhole tool may be configured to hold 100% of its rated setting strength, at least 90% of its rated strength, or at least as much strength is required to hold the tool to the casing for at least about 3 to 6 hours after contact with a downhole fluid before releasing from the casing but dissolve sufficiently in about 2 to 14 days from entering the downhole fluid so as not to interfere with fluid flow through the casing. One such tool has its slips (in one embodiment, excepting the buttons) made from magnesium alloy MOT E1 and its mandrel made from a PGA/PLA polymer acid as set forth herein, or DCP™ from Bubbletight (Needville, Tex.) or their equivalents as set forth herein. DCP is a glass fiber reinforced polymer acid. In some embodiments, the elastomer is also degradable.

Settable degradable downhole isolation tool 410 may be used as a bridge plug, packer, frac plug or for any other suitable isolation use. In one embodiment, degradable downhole tool 410 uses drop ball 432 which may be degradable. Conventional setting tools having setting rods are known in the art. Setting rod 412 may be a conventional setting rod in a conventional setting tool.

FIG. 1 illustrates downhole tool 410 which includes plug mandrel 414 which is the central support element for entraining elements on the outside of downhole tool 410 as described herein and for receiving setting rod 412 on the inside or inner bore of the downhole tool 410. In one embodiment, mandrel 414 may be made from degradable hard high density/high molecular weight degradable polymer acid or other suitable degradable polymer. Load ring 416, if used, may be entrained on the outer surface of mandrel 414 and is adapted to receive the setting tool's sleeve to set downhole tool 410 in ways known in the art. In one embodiment, load ring 416 may be made from polyglycolic acid or other suitable degradable polymer acid. Slips 418 (typically two, but may be one) and 419 (having slip bodies) are above and below cones 422 and 424, as shown in FIG. 1, and may be made of a degradable metal as disclosed herein. Center sealing element 426 is between cones 422 and 424 as shown in FIG. 1. In an embodiment, either or both lower cone 424 or upper cone 422 may be comprised of a degradable acid polymer. In one embodiment, lower cone 424 is made of a tougher or more durable grade of polymer than upper cone 422 (but may still be degradable) and other downhole tool 410 dissolvable polymer elements, such as the mandrel, and/or load ring and central element made of softer and less durable grades of polymers, so lower cone 424 thus is more capable of responding to pressure and impact without failing.

Set screws 420 may be used to retain cones' 422/424 engagement with the mandrel 414 and may be of conventional design and conventional materials or degradable materials. Center sealing element 426 may be degradable and about 82 durometer in hardness, such as a degradable elastomer as described in one embodiment, PCT/US2015/37636, incorporated herein by reference. Alternatively, the seal may be comprised of degradable metal petals or split rings. The degradable metals may be aluminum, magnesium or other degradable metal. Bottom wedge 428 may be made from degradable polyglycolic or polylactic acid or other suitable degradable acid polymer or other degradable composition. Optional drop ball 432 is configured to seat within mandrel 414 or otherwise engage the tool in ways known in the art and may be made from suitable degradable polymer or other degradable composition.

An optional shear sub 430 may be used to engage mandrel 414 and threadably receive the lower end of setting rod 412 on its internal threads 430*a*. External threads 430*b* thread into mandrel 414. Shear sub 30 is designed, shaped, and made to engage setting rod 412 and then hold setting rod 412 during setting as setting rod 412 is pulled is upward during the setting of the tool. Setting rod 412 pulls shear sub 430 upward. The vertical compression pushes slips 418 and 419 and center sealing element 26 outward against the inner wall of the casing. Slips 418 and 419 outwardly bite into the casing and central element sealingly compresses against the casing during setting downhole tool 410.

In embodiments (see FIGS. 1 and 2), shear sub 430 is comprised of a degradable metal such as aluminum, magnesium or appropriate degradable primarily metallic compositions. Shear sub 430's degradable metal has sufficient tensile strength to hold setting rod 412 within shear sub 430 as setting rod 412 is pulled upward into the setting tool. The upward force shear sub 430 may be capable of withstanding during setting ranges from about 12-14 psi. Rated strength is measured in psi of fluid pressure across a set plug. This tensile strength is typically greater than the tensile strength of the tool's mandrel, cones, load ring, or central sealing element. Because shear sub 430 must typically have a greater tensile strength than the mandrel, cones, load ring and central sealing element, degradable materials appropriate for making a degradable mandrel, cone, load ring or central element are sometimes not useful for making shear sub 430. Some embodiments of the substantially degradable plugs may have a shear sub 430 which is not substantially degradable, but other elements that are degradable.

Applicant, in one embodiment, provides a corrodible magnesium or aluminum shear sub combined with one or more of the remaining elements of the settable tool comprising a degradable polymer acid. In one embodiment, the sealing element may be KDR from Kureha or its equivalent, a degradable rubber that will degrade sufficiently in the condition set forth herein. KDR may be obtained from Kureha America, www.Kureha.com.

In an embodiment, shear sub 430 is comprised of a degradable magnesium which is sufficiently degradable so when designed, shaped, made and placed in downhole tool 410 with a polymer acid element or elements as described herein, and downhole tool 410 is placed in a borehole containing appropriate fluids, it substantially degrades in from about 2 hours to about 24 hours, or more preferably, about 4 hours to about 12 hours, and most preferably from about 6 hours to about 8 hours. If downhole tool 410 is comprised as described herein, then downhole tool 410 will release from the casing without the necessity of being milled out. In one embodiment, the degradable magnesium is Solumag from Magnesium Elektron (Magnesium Elektron North America, West Des Moines, Iowa) as found in the documents incorporated by reference or its equivalent.

In an embodiment, shear sub 430 is comprised of a degradable metal, such as aluminum or magnesium, or metal composite which, while having sufficient tensile strength to complete its described functions, is sufficiently degradable so, when designed, shaped, made and placed in downhole tool 10 as described herein, and downhole tool 410 is placed in a borehole containing appropriate fluids, it maintains it setting strength for about three hours to about nine hours. In one embodiment, it degrades sufficiently that shear sub 430 leaves a residual hard solid mass which is not more than about 15% the size of original shear sub 430.

As discussed above, a typical downhole fluid is aqueous brine that may have at least about 0.5%-2% dissolved KCl or similar naturally occurring salt or metal degrading component. In an embodiment, appropriate degradable metals are chosen for any, some or all of shear sub 430, slips 418 and 419 and cones 422/424, which will substantially degrade and fully degrade within such a typical downhole fluid. These elements will substantially degrade and fully degrade without leaving a residual shear sub or residual slips and without the need for milling downhole tool 410 or introducing a degrading fluid.

In an embodiment, the downhole fluid having a lesser or greater amount of dissolved KCl or similar naturally occurring salt or degrading component results in a slower or faster degradation rate for a degradable metal. In an embodiment, the salt composition of the downhole fluid is determined and tool elements with compositions of degradable metal appropriate for the amount of dissolved KCl or similar naturally occurring salt, and tool elements with amounts and polymer acid compositions and a degradation rate which is commercially useful in the particular borehole are selected.

Figure 2:
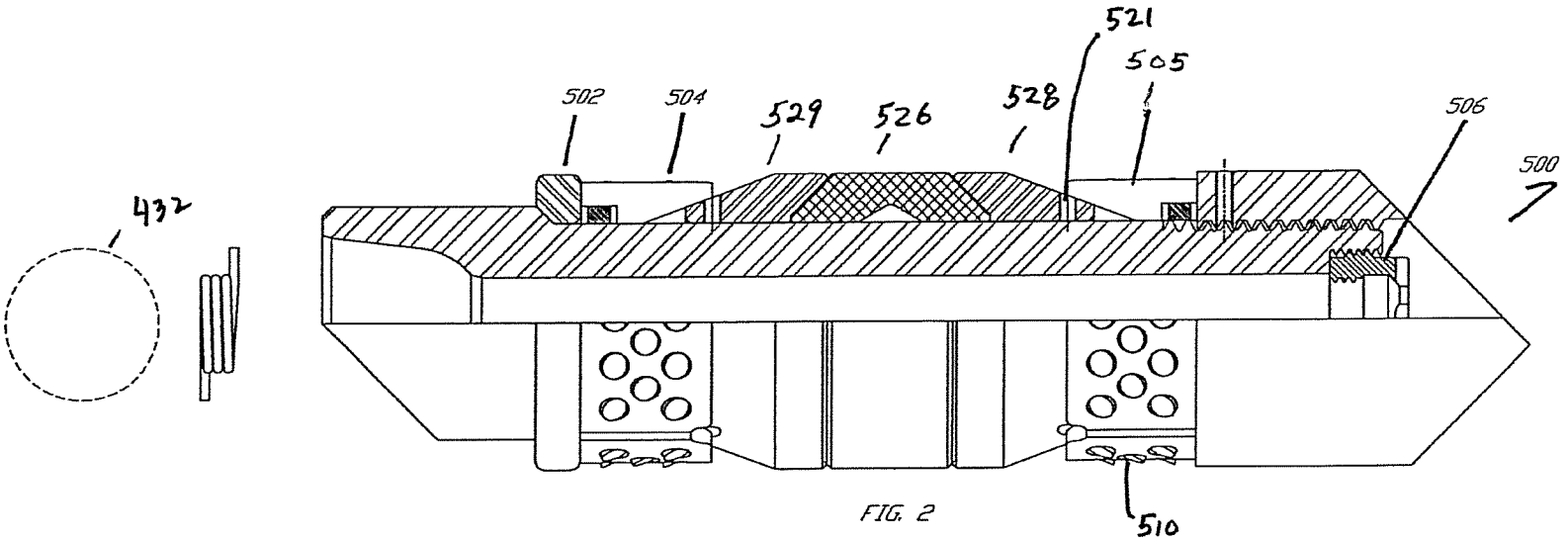
FIG. 2 is a partly cutaway elevation view of a second embodiment of a downhole tool.
Figure 3E:
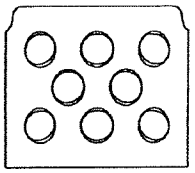
FIGS. 3A-3F are multiple views of a magnesium slip with cast iron inserts or buttons.
Figure 3D:
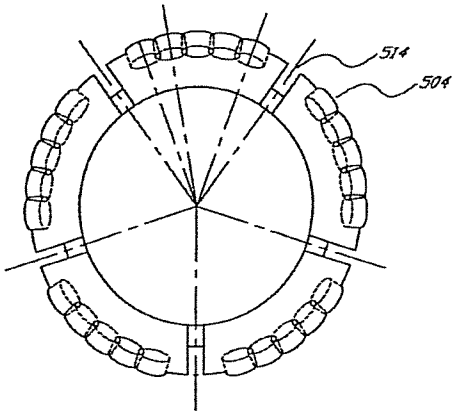
Figure 3F:
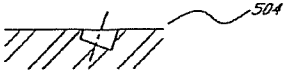
Figure 3C:
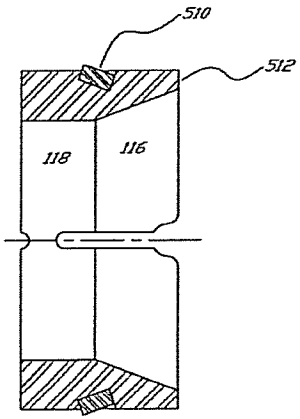
Figure 3A:
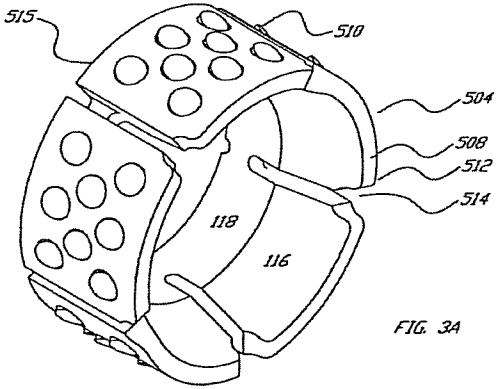
Figure 3B:
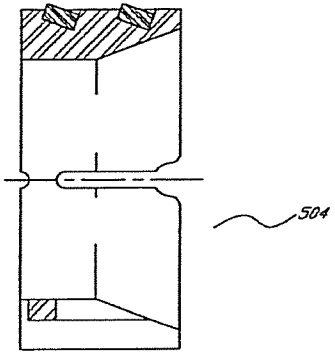

FIG. 2 illustrates downhole tool 500. In downhole tool 500 (as in downhole tool 410), some elements are at least partly comprised of a dissolvable polymer acid, in one embodiment, polyglycolic acid as in the '608 application, incorporated herein by reference. One or more other elements may include a load ring 502, slips 504 and 505 and shear sub 506 comprised of the degradable metal, such as aluminum, magnesium or other appropriate degradable metal with sufficient tensile strength. In FIG. 2, it is seen that one or more of the load ring, a slip and/or shear sub may be comprised of degradable metal with sufficient tensile strength, such as aluminum, magnesium, or any combination of one more of the foregoing in conjunction with downhole tool elements comprised of dissolvable polymer or other suitable composite in a preferred embodiment, PGA or PLA to provide a dissolvable composite tool.

Slips 504 and 505 in degradable downhole tool 500 may be made of a body 508 having on its outer surface buttons or inserts 510, which may be made of cast iron or other suitable material. Body 508 may be comprised of degradable metal having sufficient rigidity and strength to bite into the casing, perhaps with hardened whiskers, and hold downhole tool 500 against the casing during setting and isolation functions. Alternatively, body 508 may be comprised of degradable metal having sufficient rigidity and strength sufficient to hold inserts 510 and press them into biting engagement with the casing sufficient to hold downhole tool 500 against the casing during setting and isolation functions. Inserts 510 may be conventional or similar to prior art buttons or inserts. The inserts may, in one embodiment, be cast iron, providing an "all metal" slip or slips.

FIGS. 3A-3F provide additional details concerning the design and construction of slips 504 and 505. Magnesium, aluminum or other degradable metal body 508 includes buttons or inserts 510, in one embodiment, cast iron inserts. Leading edge 512 of slips 504 and 505 may include multiple grooves 514 (see FIG. 3D) partially cut through from leading edge 512 to trailing edge 515. Slips 504 and 505 each separate along their grooves during setting. Tapered inner walls 516 and non-tapered inner walls 518 operate in conjunction with the setting, load ring, and cones in ways known in the art.

In some embodiments, slips 504 and 505 are at least partly comprised of a degradable metal, such as aluminum or magnesium which either has sufficient tensile strength and hardness to bite into the casing during setting of the downhole tool 500 and during fracking of the well, or sufficient tensile strength to hold inserts for biting into the casing.

In some embodiments, slips 504 and 505 are comprised of a degradable magnesium which is sufficiently degradable that, when designed, shaped, made and placed in downhole tool 410 as described herein, and downhole tool 410 is placed in a borehole containing appropriate fluids, slips 104 and 105 substantially degrade in about 24 hours to 48 hours.

Downhole tool 410 may be run in with a fluid in which the magnesium or other degradable metal and the polymer acid elements are dissolvable (such as downhole brine and introduced salt solutions) and/or encounter natural wellbore fluids which will dissolve magnesium or other degradable metal.

Figure 5:
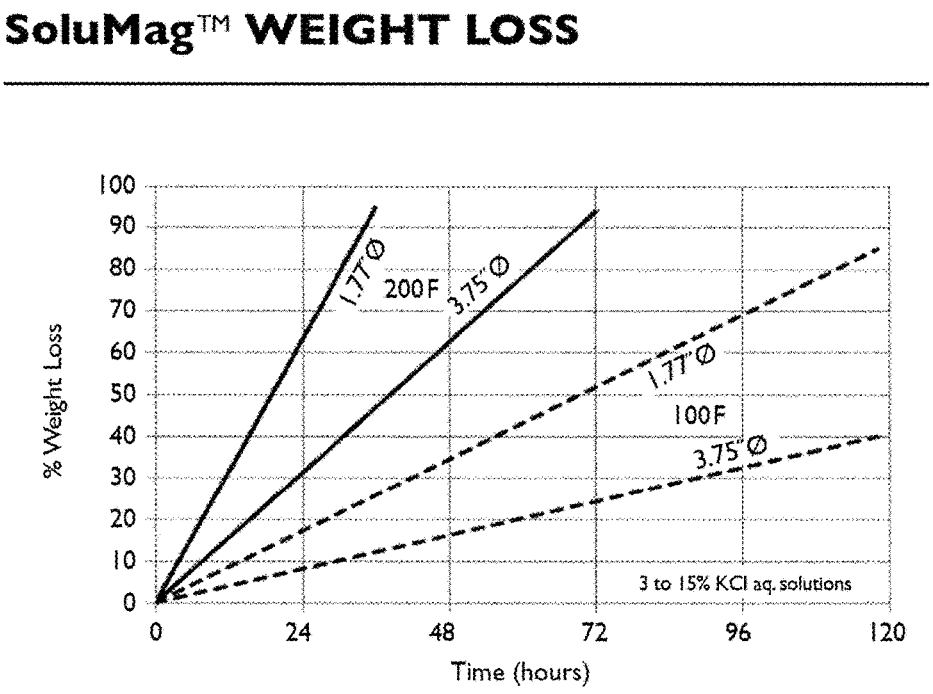
FIGS. 5 and 6 are weight loss and surface area corrosion rate graphs for SoluMag™, a degradable magnesium alloy.
Figure 6:
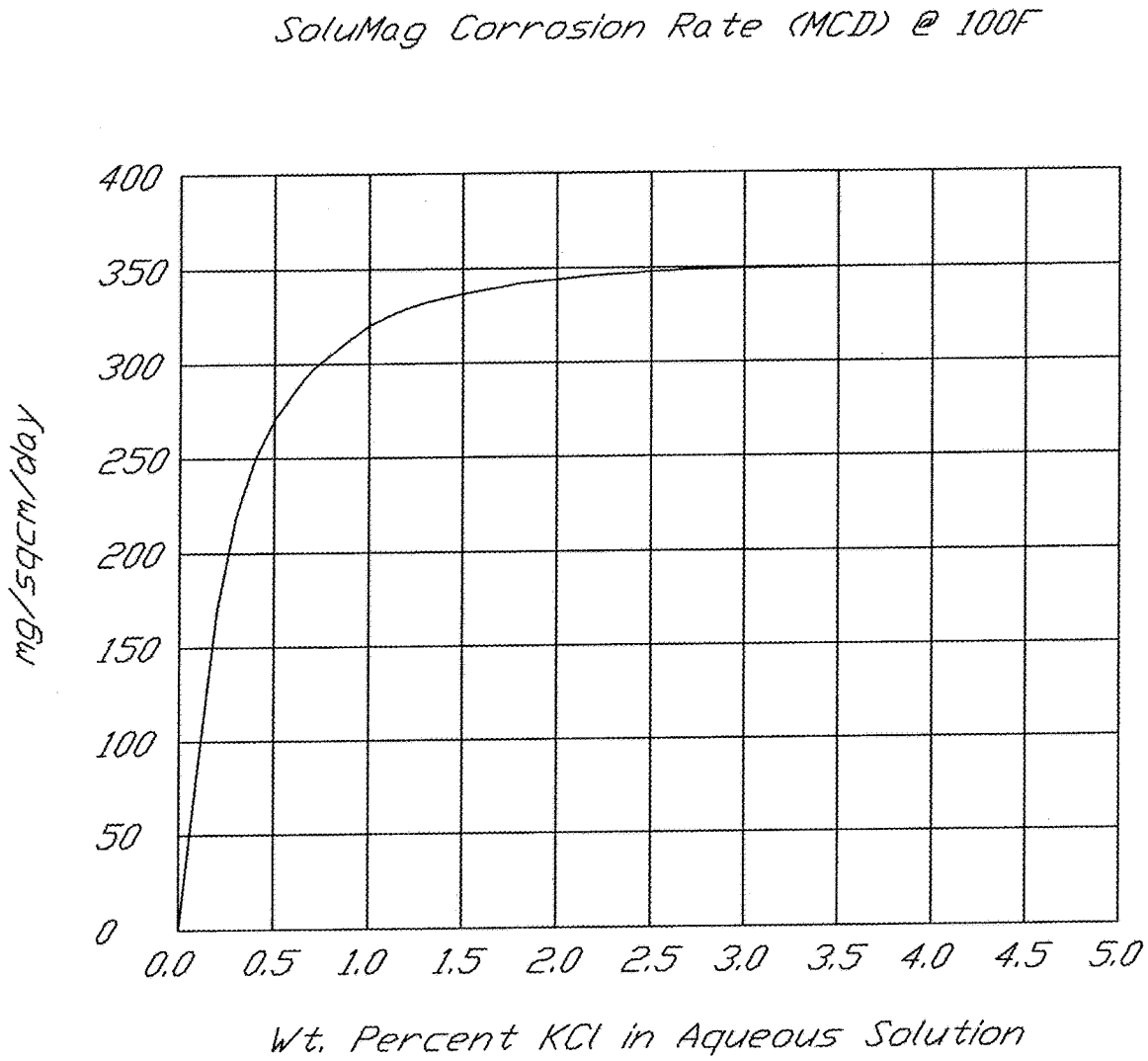

SoluMag magnesium alloy, available from Magnesium Elektron, see US 2016/0024619 incorporated herein by reference or its equivalent may be used in the tool. It is a high strength magnesium alloy that has a high corrosion rate in an aqueous chloride environment. Its corrosion properties in about 1%-15% KCl aqueous at 200° F., 1300 to 1500 $mg/cm^2/day$ (MCD), 100° F., 200-400 $mg/cm^2/day$ (MCD) are shown in FIGS. 5 and 6. It has a yield strength (up to 1 inch) of 35/240 ksi/MPa. It has an ultimate yield strength of (up to 1 inch) 49/340 ksi/MPa and elongation up to 1 inch of about 20%. CYS 32.5 ksi/224 MPa. It has a density ($g/cm^3$) of about 1.85 and percent weight loss (3-15% KCl aqueous) set forth in FIG. 5.

Figure 4:
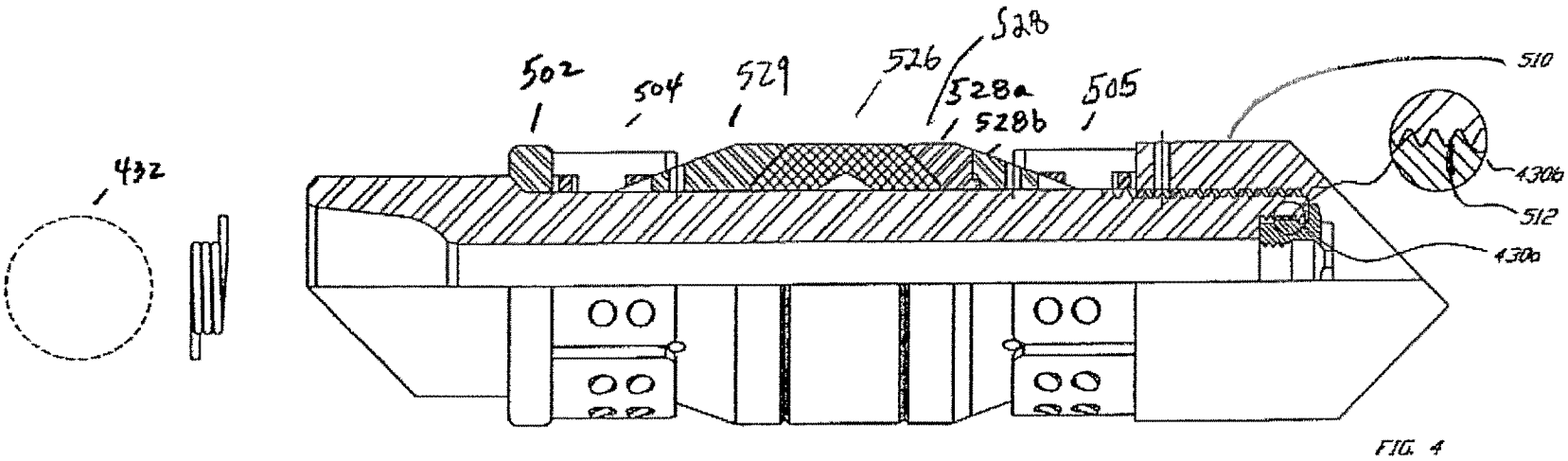
FIG. 4 is a partly cutaway elevational view of a third embodiment of a downhole tool.

FIG. 4 illustrates that internal threads 430*a* and/or external threads 430*b* of magnesium shear sub 430 (or any other metal part of a downhole tool as set forth herein) may be treated to slow their degradation to better maintain rated preset shear values. An epoxy or other coating 510 may be used, brushed on, sprayed on or otherwise applied to magnesium or other metal, including the threads 430*a*/430*b*. The coating may be applied prior to the tool arriving at the well site or applied in the field during assembly and before sending the tool downhole. A Xylan® coating, such as a fluoropolymer coating may be provided for the same purposes and to lower friction and delay the reaction of the metal with the fluid. A powder coating or other corrosion or degradation retarding coating may be applied to any other magnesium or metallic parts to help delay, at least initially, degradation rates. It is believed that as the polymer acid dissolves there is a delay before the acid produced reaches a sufficient concentration in the downhole fluid adjacent the tool's degradable metal parts so the rated setting strength of the tool is maintained, for at least 6 hours (in some embodiments, 2 to 4 hours).

In one embodiment, a degradable metal, such as aluminum, zinc or magnesium or other suitable metal or metal alloy is either a powder based metal element, or is wrought or drawn. In an embodiment, an additive or dopant is added to the degradable metal to increase its degradation or oxidation rate. To delay initial degradation, downhole tool elements comprised of degradable metal may be coated with layer or coating 510, which is less degradably reactive to the downhole fluid than the degradable metal. The composition of the layer and the thickness of the layer may be varied to speed or delay degradation. Degradable metal compositions may be selected employed to provide greater strength, lesser or greater speed of degradation.

FIG. 4 also illustrates the optional use of a two-piece bottom cone, the two portions illustrated as 528*a* and 528*b* in FIG. 4. Upper portion 528*a* of the two-piece lower cone rests against the center pack off or elastomer element 526 and may be comprised of a polyglycolic or polylactic acid polymer or other acid polymer or suitable tough, degradable, non-composite material. Lower portion 528*b* of the two-portion may be degradable magnesium or other degradable metal or metal alloy as described herein. It is believed that the two-piece lower cone may better withstand the sudden above tool frac pressures applied when the tool is used as a frac plug.

In some embodiments, one or more of the degradable or corrodible metallic elements of any of the downhole tools may be comprised of Solumag magnesium or its equivalent, such as the metallic elements including the slips 418/419/504/505, bottom cone 528 and, optionally, load rings 416/502.

In a degradable tool that combines degradable, corrodible metallic elements and degradable polymer acid polymer, such as PLA or PGA or a combination of PLA and PGA or other acid producing hydrolytically degradable polymer, a low temperature degradable polymer may be used. Low temperature means a degradable polymer that will degrade at a minimum temperature of about 100 to 150° F. In one embodiment, the low temperature dissolvable material may be DCP™ available from BubbleTight, LLC, Needville, Tex. or its equivalent. A degradable polymer is considered low temperature when dissolution of the polymer part is substantially complete in the aforementioned minimum temperature range at a time between 1 to 4 days in a brine solution.

In a preferred embodiment, a degradable part is comprised of a hydrolytically degradable a polymer acid, such as PLA (polylactic acid) or PGA (polyglycolic acid) or their equivalents, combined with one or more parts of corrodible metallic elements: such as magnesium, aluminum or zinc or the like.

The dissolution rate of a plug with degradable metallic elements in aqueous brine at a temperature range of about 100°–250° F., is stated in percent weight loss or a decrease in wall thickness (resulting in a loss in ksi rating of the plug). Placement of elements comprising acidic polymers, such as PLA or PGA, adjacent or near to elements in the tool comprising metallic alloys increases the rate of dissolution of the metal elements at least by about 10% or 20% or up to 50% in some fluids. In some cases, the metal elements' corrosion rates with polymer acid elements and brine may be several multiples of the corrosion rates of the metals in brine alone.

In a preferred embodiment, a tool's metal alloy element substantially dissolves in downhole fluid at least about 10% faster in the presence of the dissolving polymer acid element than the metal alloy element will dissolve in the downhole fluid without the presence of the dissolving polymer acid element.

The polymer acid element is believed to hydrolyze in the aqueous downhole fluid and produce an acid reaction product which sufficiently speeds dissolution of the metal element. The polymer acid element and the metal alloy element are located close enough together and the polymer acid element is large enough that the polymer acid elements' hydrolytic acid product is sufficiently communicated to the metal elements, and the dissolving polymer acid element produces enough acid reaction product so the polymer acid elements' produced acid causes the metal elements to dissolve at least faster 10% faster, and in some embodiments, 20%, 30%, 40% or 50% or more faster, and in controllable increments.

FIG. 2 illustrates settable tool 500, in one embodiment having a metallic alloy, such as a magnesium alloy, (MOT E1) for slips 504/505, and/or bottom cone 528, and/or shear sub 506 and/or a load ring 502. One or more of the following elements may be made of a dissolvable polymer acid such as Kuredux (a PGA) or PLA or their equivalents: mandrel 501, top cone 529, load ring 502, and shoe nut bottom or shear sub 506. In one embodiment, the "rubber" central element 526 may be an elastomer that dissolves under the conditions stated herein for dissolution of the metal and polymer acid components, such as KDR™ from Kureha or DEP 88X™, a aqueous degradable elastomeric polymer from Bubbletight, LLC, useful in low temperature aqueous downhole fluid, or their equivalents. In some embodiments, set screws 521 may be carbon steel and the slip inserts or buttons 510 may be heat treated ductile iron, heat treated powder metal or other hard durable material. The buttons 510 may be powder metal buttons and may corrode in the conditions set forth herein.

The downhole fluid required to achieve tool dissolution is typically an aqueous or at least partially aqueous solution with some chloride content. The water facilitates hydrolysis of the polymer acid. The acid reaction products react with the tool's metallic elements. The metallic elements may corrode in sour oil and gas, but in an aqueous downhole fluid, its chlorine ion is believed to be a primary corrosion mechanism.

In a low temperature downhole settable tool, in one embodiment (see FIG. 4), slips 504/505, shear sub 506, and load ring 502 may be made from a magnesium or aluminum. In one embodiment, magnesium alloy MOT E1 is used in: slips, shear sub, and load ring. The polymer acid degradable plastic may be DCP degradable composite and used in: mandrels, top and bottom cones, shoe nut bottom. A dissolvable elastomer 526 may be made from KDR or DEP or their equivalents. Shear screws and buttons may be as set forth herein. When a low temperature downhole settable tool is used in conjunction with a frac ball, the frac ball 432 may be comprised of BubbleTight PCP.

For all magnesium and aluminum alloys set forth, the base metal of the alloy is less significant than the extent to which the alloy is sensitive to corrosion in the presence of water and, in one embodiment, chloride ions present in water. Some magnesium, aluminum and zinc alloys are corrodible enough and strong enough for certain embodiments of the described downhole tools. Magnesium alloy MOT E1 may be SoluMag® or Tervalloy® or their equivalents. In some embodiments, the degradable metal is manufactured to have a controlled rate of dissolution, such as a metal case structure that includes a base metal or base metal alloy with a plurality of insoluble particles disbursed in the metal cast structure, the insoluble particles having a melting point greater than the melting point of the base metal or base metal alloy, at least 50% of the insoluble particles located in grain boundary layers of the metal cast structure. See US2015/0240337, incorporated herein by reference.

While the described reaction uses chlorides in the aqueous downhole fluid, it does not consume the chlorides. The aqueous downhole fluid provides an environment for metal corrosion at a faster rate with the produced acid than without the acid. The acid and metal reaction consumes the acid, but continued dissolution of the tool's polymer elements replenishes the acid.

For storage and shipping, downhole tools or their elements may be boxed with a desiccant, or bagged in a vacuum bag (with or without a desiccant, so corrosion by moisture and/or air is limited).

Figure 7:
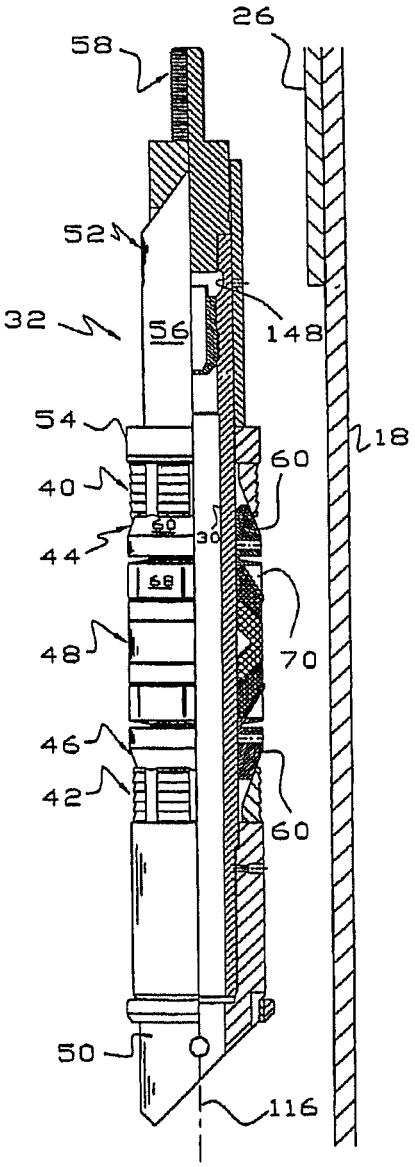
FIG. 7 is an embodiment of a settable degradable downhole tool.

FIG. 7 is an illustration from U.S. Pat. No. 9,388,622, incorporated herein by reference (FIG. 3 in the '622 patent). The '622 patent discloses a settable downhole tool that, in one embodiment, may be made of a smaller OD than prior art tools and still able to expand into setting engagement with a production string. Such a tool can pass through a section of the casing which is restricted. For example, in some situations, the heel or curved section of the horizontal leg is more restricted than expected or the wellbore may have a casing patch. In the settable downhole "long range" tool or tools disclosed in the '622 patent, any of the embodiments may be made in part from degradable polymer acid polymer and any of the other elements may be a degradable metal alloy as set forth herein. For example, the mandrel may be a hydrolytically degradable polymer. Load ring 54 and slip 40 may be a degradable metallic material, set screws 44 may or may not be degradable, cone 60, backup 68, mandrel 30, and element 70, center element 48, bottom cone ring 46, bottom slip 42, and shoe nut bottom 50 may all be degradable. Any one or more of the foregoing elements may be a degradable polymer acid and any one or more of the foregoing elements may be a degradable metallic alloy. Use of the disclosed compositions and configurations in a long-range plug is particularly useful because such plugs are often used in fracking long horizontal legs of wells.

Drilling out plugs in horizontal legs is difficult and often leaves debris which interferes with completing and producing the horizontal leg. A long-range plug which degrades and degrades completely and degrades completely more quickly than other degradable plugs is particularly useful in fracking horizontal legs. Use of the degradable plug described herein may be particularly beneficial in fracking horizontal legs of wells.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. It is intended that the invention not be limited to the particular embodiment disclosed as one mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. Unless expressly stated to the contrary, all numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

The terms "up" and "down"; "upward" and "downward"; "upper" and "lower"; "upwardly" and "downwardly"; "upstream" and "downstream"; "above" and "below"; and other like terms as used herein refer to relative positions to one another and are not intended to denote a particular spatial orientation since the tool and methods of using same can be equally effective in either horizontal or vertical wellbore uses.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

The invention claimed is:

1. A degradable settable downhole tool for engaging a casing at a rated setting strength in a well and temporarily isolating a first zone in the well from a second zone in the well, the casing containing an aqueous downhole fluid, the downhole tool comprising:

a degradable mandrel comprising at least in part, a hard hydrolytically degradable acid polymer solid which will hydrolytically degrade in the aqueous downhole fluid, the mandrel's degradation releasing an acid into the downhole fluid;

a slip having a slip body;

a cone proximate the slip;

wherein at least one of the slip body or cone comprises at least in part a non-ferrous degradable metal that will degrade in the downhole fluid at a temperature between about 100° F. and 250° F., at least 10% faster in the presence of the acid from the mandrel than the slip body or cone would degrade in the downhole fluid in the absence of the mandrel's released acid, and wherein the tool will engage the casing at the tool's rated setting strength for at least about three hours after entering the downhole fluid in the casing;

wherein the tool will sufficiently degrade in less than about fourteen days to not interfere with fluid flow through the casing.

2. The downhole tool of claim 1, wherein the tool will maintain its rated setting strength after entering the downhole fluid in the casing for at least about four hours and will sufficiently degrade in less than about six days to permit completion operations in the casing without drilling out the tool.

3. The downhole tool of claim 1, wherein the tool will maintain its rated setting strength after entering the downhole fluid in the casing for at least about five hours and will sufficiently degrade in less than about four days to permit completion operations in the casing without drilling out the tool.

4. The downhole tool of claim 1, wherein the tool is configured so at least one of the cone or the slip body comprising the degradable non-ferrous metal degrades in an aqueous brine solution at a downhole fluid temperature between about 100° F. and 250° F. at least 20% faster in the presence of the acid released from the mandrel's acid polymer than the cone or slip would degrade in the downhole fluid in the absence of the acid released from the mandrel's acid polymer.

5. The downhole tool of claim 1, wherein the non-ferrous metal is a degradable magnesium, aluminum or zinc.

6. The downhole tool of claim 1, wherein the tool is configured so the metal cone or slip body degrades in the downhole fluid at least 30% faster in the presence of the acid released from the mandrel's acid polymer than in the absence of acid release from the mandrel's acid polymer.

7. The downhole tool of claim 1, wherein the degradable acid polymer is at least in part a hard, high molecular weight polyglycolic acid or polylactic acid.

8. The downhole tool of claim 1, wherein the degradable acid polymer comprises polyglycolic acid.

9. The downhole tool of claim 1, wherein the degradable acid polymer comprises a degradable composite polymer.

10. The downhole tool of claim 1, wherein the degradable metal degrades in a solution comprised of water and chlorides and the solution has a pH of less than 7.

11. The downhole tool of claim 10, wherein the degradable metal comprises magnesium alloy with a corrosion rate of 300-600 mg/sq.cm/day at 1% KCl and 300-1500 mg/sq.cm./day at 5% KCl.

12. The downhole tool of claim 1, wherein the degradable metal degrades in a solution comprised of freshwater.

13. The downhole tool of claim 1, wherein the degradable metal is a degradable zinc.

14. The downhole tool of claim 1, wherein the degradable metal comprises magnesium that dissolves at about 200-1500 mg/cm$^2$/day in about a 1-5% KCl aqueous solution at a temperature between about 100-200° F.

15. The downhole tool of claim 1, wherein the degradable metal is magnesium alloy capable of dissolving in fresh water.

16. The downhole tool of claim 1, further comprising a second slip, a bottom cone, a shear release shear sub and a load ring, and wherein at least one of the foregoing comprise the non-ferrous metal or metal alloy.

17. The downhole tool of claim 16, wherein the polymer acid comprises at least in part a degradable polyglycolic acid or polylactic acid and the downhole tool further comprises one or more of the following, which is comprised of the degradable polymer acid: a top cone, a bottom sub and a shoe nut bottom, and wherein downhole tool further comprises a central sealing element, the central sealing element being dissolvable in the downhole fluid.

18. The downhole tool of claim 17, wherein an inner portion of the slips is comprised of the degradable non-ferrous metal and an outer surface of the slips has heat treated ductile iron buttons or heat treated powder metal buttons.

19. The downhole tool of claim 1, wherein there are at least two slips, and the tool further comprises a load ring and a shear sub, and all of the foregoing are comprised at least in part of the degradable non-ferrous metal; and wherein the degradable non-ferrous metal is magnesium alloy.

20. The downhole tool of claim 19, wherein the tool further comprises a top cone and a bottom cone and a shoe nut bottom, and all of the foregoing are at least partly comprised of a composite polyacid plastic.

21. A degradable settable downhole tool having a rated setting strength for engaging a casing in a well containing a downhole fluid and temporarily isolating a first zone in the well from a second zone in the well, the downhole tool comprising:

a mandrel;

a slip having a slip body;

a cone proximate the slip; and wherein at least one of the mandrel, slip or cone comprises, as least in part, a hard polymer acid based solid that will degrade in the downhole fluid and release an acid into the downhole fluid, and wherein at least one of the mandrel, slip or cone comprises, at least in part, a non-ferrous metal whose rate of degradation in the downhole fluid will increase due to the acid relative to degradation in the downhole fluid without the acid; and wherein the tool is configured to be set in the casing to isolate a zone above the tool from a zone below the tool, hold its rated strength for at least about six hours after entry into the downhole fluid, after at least about six hours to no longer hold its rated strength, and after about two days have degraded so as to not interfere with fluid flow through the casing at the setting location.

22. The downhole tool of claim 21, wherein the tool is configured to be set in the casing to isolate a zone above the tool from a zone below the tool, hold its rated strength for at least about six hours after entry into the downhole fluid in the casing, after at least about six hours to no longer hold its rated strength, and after about one day have degraded to not interfere with fluid flow through the casing at the setting location.

23. The downhole tool of claim 21, wherein the tool is configured to be set in the casing to isolate a zone above the tool from a zone below the tool, hold its rated strength for at least about six hours after entry into the downhole fluid in the casing, after at least about six hours to no longer hold its rated strength, and after about six hours have degraded to not interfere with fluid flow at the setting location.

24. A degradable settable downhole tool for engaging a casing in a well and temporarily isolating a first zone in the well from a second zone in the well containing an aqueous downhole fluid comprising at least about 2% KCl or other salt, the downhole tool comprising:

a mandrel comprising a hard degradable acid polymer solid which will degrade in the downhole fluid and release an acid into the downhole fluid;

a slip proximate the mandrel having a slip body, and;

a cone proximate the slip;

wherein the tool is configured to be settable in the casing to isolate a zone above the tool from a zone below the tool; the cone or slip body comprises a degradable non-ferrous metal which degrades faster in the downhole fluid in the presence of the acid released from the mandrel so if the tool is set in the casing in the downhole fluid having a temperature of at least about 100° F.; the tool will release from the casing at least about 10% faster due to the acid released from the mandrel than if the mandrel did not release the acid; and wherein the tool will remain set in the casing and isolate the zones for at least about six hours after entry into the downhole fluid; then release from the casing due to degradation; and due to tool degradation, cease interfering with fluid flow through the casing in about four days or less after entry into the downhole fluid.

25. A degradable settable downhole tool for engaging a casing at a rated setting strength, the casing containing a downhole fluid, the downhole tool comprising:

a mandrel;

a slip having a slip body;

a cone proximate the slip; and wherein at least one of the mandrel, slip or cone comprises, as least in part, a hard polymer acid solid that will degrade and release an acid into the downhole fluid, and wherein at least one of the mandrel, slip or cone comprises, at least in part, a non-ferrous metal alloy whose rate of degradation in a fluid will increase in the presence of acid relative to degradation in the same fluid without the acid; and wherein the tool is configured to be set in the casing to isolate a zone above the tool from a zone below the tool, hold its rated strength for at least six hours after entry into the downhole fluid in the casing, after at least about six hours to no longer hold its rated strength, and within about fourteen days have degraded to not interfere with fluid flow at the tool's setting location in the casing.

26. A degradable settable downhole tool for engaging a casing at a rated setting strength in a well and temporarily isolating a first zone in the well from a second zone in the well, the casing containing an aqueous downhole fluid, the downhole tool comprising:

a mandrel having a first end and a second end, an exterior and an interior, the interior having an interior diameter;

a top ring engaging the first end of the mandrel at the exterior thereof;

a bottom subassembly engaging the second end of the mandrel at the exterior thereof;

an upper and lower slip adjacent the exterior of the mandrel between the first and second ends thereof, the slips each having a slip body and multiple inserts on an exterior surface of each slip body;

a sealing element adjacent the exterior surface of the mandrel between the slips;

a first wedge and a second wedge longitudinally adjacent the sealing element on either side thereof, the first wedge engaging the first slip and the second wedge engaging the second slip;

wherein at least one or more of the following group is made from a polymer acid that will degrade in the aqueous downhole fluid: at least one of the slips, the mandrel, at least one of the wedges, the top ring, the bottom subassembly; and wherein at least another of the foregoing group is made of non-ferrous metal or metal alloy that will degrade at least about 10% faster in the well due to polymer acid released from the degrading polymer element acid.

27. The downhole tool of claim 26, wherein the polymer acid parts are large enough to produce enough acid, and are close enough to the metal parts that the metal parts will degrade 10% faster due to the effect of the acid on the metal parts.

28. The downhole tool of claim 26, wherein the tool includes a shear sub having threads, the tool's shear sub threads are coated with a retardant which retards their degradation.

29. A degradable settable downhole tool for setting in a casing in a well at a rated setting strength and temporarily isolating a first zone in the well from a second zone in the well, the casing having an aqueous downhole fluid, the tool comprising:

a mandrel comprising a hard, hydrolytically degradable acid polymer solid which will hydrolytically degrade in the aqueous downhole fluid, degradation of the mandrel releasing an acid into the downhole fluid;

a nonferrous metal element about the mandrel, the element comprising either a slip body of a slip or a cone proximate the slip, the non-ferrous metal element being degradable in the released acid;

the tool being settable in the casing at the rated setting strength to isolate the first zone from the second zone, and maintain the rated setting strength after entering the downhole fluid for at least about three hours;

the tool comprised and configured so at least some of the released acid will degrade the non-ferrous metal element, and the tool will degrade in less than about fourteen days to not substantially interfere with fluid flow through the casing, so hydrocarbons can be produced from the well without drilling or milling the tool or introducing a new degrading fluid to the tool.

30. The tool of claim 29, wherein the tool will degrade in less than about five days to not substantially interfere with fluid flow through the casing, so hydrocarbons can be produced from the well without drilling or milling the tool or introducing a new degrading fluid to the tool.

31. The tool of claim 29, wherein the tool will degrade in less than about three days to not substantially interfere with fluid flow through the casing, so hydrocarbons can be produced from the well without drilling or milling the tool or introducing a new degrading fluid to the tool.

32. The tool of claim 29, wherein the tool will degrade in less than about two days to not substantially interfere with fluid flow through the casing, so hydrocarbons can be produced from the well without drilling or milling the tool or introducing a new degrading fluid to the tool.

33. The tool of claim 29, wherein the tool ceases to substantially interfere with fluid flow through the casing, so hydrocarbons can be produced from the well without drilling or milling the tool or introducing a new degrading fluid to the tool at least about 10% faster from insertion of the tool into the downhole fluid due to degradation of the metal element by the released acid than without degradation of the metal element by the released acid.

34. The tool of claim 29, wherein the tool ceases to substantially interfere with fluid flow through the casing, so hydrocarbons can be produced from the well without drilling or milling the tool or introducing a new degrading fluid to the tool at least about 20% faster from insertion of the tool into the downhole fluid due to degradation of the metal element by the released acid than without degradation of the metal element by the released acid.

35. The tool of claim 29, wherein the tool ceases to substantially interfere with fluid flow through the casing, so hydrocarbons can be produced from the well without drilling or milling the tool or introducing a new degrading fluid to the tool at least about 30% faster from insertion of the tool into the downhole fluid due to degradation of the metal element by the released acid than without degradation of the metal element by the released acid.

36. The tool of claim 29, wherein the tool ceases to substantially interfere with fluid flow through the casing, so hydrocarbons can be produced from the well without drilling or milling the tool or introducing a new degrading fluid to the tool at least about 40% faster from insertion of the tool into the downhole fluid due to degradation of the metal element by the released acid than without degradation of the metal element by the released acid.

37. The tool of claim 29, wherein the downhole fluid is substantially freshwater and the tool ceases to substantially interfere with fluid flow through the casing, so hydrocarbons can be produced from the well without drilling or milling the tool or introducing a new degrading fluid to the tool at least about 20% faster from insertion of the tool into the downhole fluid due to degradation of the metal element by the released acid than without degradation of the metal element by the released acid.

38. The tool of claim 29, wherein the downhole fluid is substantially a brine solution and the tool ceases to substantially interfere with fluid flow through the casing, so hydrocarbons can be produced from the well without drilling or milling the tool or introducing a new degrading fluid to the tool at least about 20% faster from insertion of the tool into the downhole fluid due to degradation of the metal element by the released acid than without degradation of the metal element by the released acid.

39. The tool of claim 29, wherein the non-ferrous metal element is comprised of one or more of: magnesium, aluminum, zinc or chromium.

40. The tool of claim 29, wherein the mandrel is comprised of one or more of the following polymer acids: polyglycolic acid or polylactic acid.

41. The tool of claim 29, wherein the mandrel is a composite.

42. The tool of claim 29, wherein the mandrel is a non-composite.

43. The tool of claim 29 should wherein:

the tool is comprised and configured to set in the casing at the rated setting strength, isolate the first zone from the second zone, and maintain its rated setting strength after entering the downhole fluid for at least about six hours; and the tool is comprised and configured so at least some of the released acid speeds degradation of the degradable non-ferrous metal element, and the tool will sufficiently degrade in less than about 7 days to not interfere with fluid flow through the casing without milling or drilling the tool.

44. The tool of claim 29 wherein the non-ferrous metal element will degrade in the downhole fluid in the casing at a temperature between about 100° F. and 250° F. at least 10% faster in the presence of the released acid than in the absence of the released acid.

45. The tool of claim 29 wherein the non-ferrous metal element will degrade in an aqueous brine downhole fluid in the casing at a temperature between about 100° F. and 250° F., at least 10% faster in the presence of the released acid than in the absence of the released acid.

46. A degradable settable downhole tool for setting in a casing in a well at a rated setting strength and temporarily isolating a first zone in the well from a second zone in the well, the casing having an aqueous downhole fluid, the tool comprising:

a mandrel comprising a hard, hydrolytically degradable acid polymer solid which will hydrolytically degrade in the aqueous downhole fluid, degradation of the mandrel releasing an acid into the downhole fluid, wherein the mandrel is comprised of one or more of the following polymer acids: polyglycolic acid or polylactic acid;

a nonferrous metal element about the mandrel, the element comprising either a slip body of a slip or a cone proximate the slip, the non-ferrous metal element being degradable in the released acid, the non-ferrous metal element comprised of one or more of: magnesium, aluminum, zinc or chromium, and the non-ferrous metal element will degrade in the downhole fluid in the casing at a temperature between about 100° F. and 250° F. at least 10% faster in the presence of the released acid than in the absence of the released acid;

the tool being settable in the casing at the rated setting strength to isolate the first zone from the second zone, and maintain the rated setting strength after entering the downhole fluid for at least about three hours;

the tool comprised and configured so at least some of the released acid will degrade the non-ferrous metal element, and the tool will degrade in less than about three days to not substantially interfere with fluid flow through the casing, so hydrocarbons can be produced from the well without drilling or milling the tool or introducing a new degrading fluid to the tool.

* * * * *